US007297371B2

(12) United States Patent
Simmons et al.

(10) Patent No.: US 7,297,371 B2
(45) Date of Patent: Nov. 20, 2007

(54) DIRECT PRESSURE APPARATUS AND METHOD FOR DISPENSING COATINGS

(75) Inventors: Walter Neal Simmons, Durham, NC (US); Walter John Simmons, Martinsburg, WV (US)

(73) Assignee: Terrasimco Inc., Martinsburg, WV (US)

( * ) Notice: Subject to any disclaimer, the term of this patent is extended or adjusted under 35 U.S.C. 154(b) by 0 days.

(21) Appl. No.: 10/959,092

(22) Filed: Oct. 7, 2004

(65) Prior Publication Data

US 2005/0048215 A1 Mar. 3, 2005

Related U.S. Application Data

(63) Continuation of application No. 10/361,727, filed on Feb. 11, 2003, now Pat. No. 6,832,699.

(60) Provisional application No. 60/358,351, filed on Feb. 22, 2002.

(51) Int. Cl.
*B05D 5/00* (2006.01)

(52) U.S. Cl. ..... 427/421; 427/422; 427/426; 222/146.1; 222/386.5; 347/21

(58) Field of Classification Search ..... 427/421, 427/422, 426; 222/146.1, 386.5; 347/21
See application file for complete search history.

(56) References Cited

U.S. PATENT DOCUMENTS

| | | | | |
|---|---|---|---|---|
| 4,159,789 A | | 7/1979 | Stoody | 222/148 |
| 4,301,119 A | * | 11/1981 | Cobbs et al. | 422/133 |
| 4,328,843 A | | 5/1982 | Fujii | 14/1 |
| 4,555,712 A | | 11/1985 | Arway et al. | 346/75 |
| 4,621,927 A | | 11/1986 | Hiroi | 366/132 |
| 4,679,706 A | | 7/1987 | Magid et al. | 222/130 |
| 4,734,227 A | | 3/1988 | Smith | 264/13 |
| 4,923,720 A | | 5/1990 | Lee et al. | 427/422 |
| 5,178,325 A | | 1/1993 | Nielsen | 239/1 |
| 5,197,800 A | * | 3/1993 | Saidman et al. | 366/136 |
| 5,215,253 A | | 6/1993 | Saidman et al. | 239/61 |

(Continued)

FOREIGN PATENT DOCUMENTS

EP 0 677 332 A2 10/1995

(Continued)

OTHER PUBLICATIONS

Michael Roth, "Helium Head Pressure Carbon Dioxide in Supercritical Fluid Extraction and Chromatography: Thermodynamic Analysis of the Effects of Helium", *Anal. Chem.*, vol. 70, pp. 2104-2109 (1998).

(Continued)

*Primary Examiner*—Alain L. Bashore
(74) *Attorney, Agent, or Firm*—Steptoe & Johnson LLP

(57) ABSTRACT

The invention is related to a coating delivery system that includes at least one pressure vessel operable in sealed and unsealed conditions, a deliverable substance including a coating component interspersed with at least one of liquefied carbon dioxide and supercritical carbon dioxide, and a pressurizing fluid. The deliverable substance is disposed in a first pressure vessel of the at least one pressure vessel, and the pressurizing fluid directly exerts a pressure on the deliverable substance to effect transport thereof when the pressure vessel is in the unsealed condition. The deliverable substance may be spray discharged.

28 Claims, 5 Drawing Sheets

U.S. PATENT DOCUMENTS

| | | | | |
|---|---|---|---|---|
| 5,215,257 | A | 6/1993 | Barcza | 239/265.39 |
| 5,318,225 | A | 6/1994 | Condron | 239/1 |
| 5,330,783 | A | 7/1994 | Saidman et al. | 427/8 |
| 5,407,132 | A * | 4/1995 | Messerly et al. | 239/124 |
| 5,407,267 | A | 4/1995 | Davis et al. | 366/152 |
| 5,464,283 | A | 11/1995 | Davis | 366/152.1 |
| 5,499,750 | A | 3/1996 | Manifold | 222/386.5 |
| 5,505,539 | A | 4/1996 | Lee et al. | 366/152.2 |
| 5,526,957 | A | 6/1996 | Brown et al. | 222/94 |
| 5,823,478 | A | 10/1998 | Dunn | 244/172 |
| 5,863,612 | A | 1/1999 | DeSimone | 427/422 |
| 6,127,000 | A | 10/2000 | Carbonell et al. | 427/393.6 |
| 6,200,637 | B1 | 3/2001 | McClain et al. | 427/336 |
| 6,234,352 | B1 | 5/2001 | Richard et al. | 222/95 |
| 6,471,327 | B2 | 10/2002 | Jagannathan et al. | 347/21 |
| 6,482,390 | B1 | 11/2002 | Hiscocks et al. | 424/45 |
| 6,623,686 | B1 * | 9/2003 | Janikowski et al. | 264/343 |
| 2002/0118245 | A1 * | 8/2002 | Jagannathan et al. | 347/21 |
| 2003/0083397 | A1 * | 5/2003 | Bradford et al. | 522/173 |
| 2005/0150453 | A1 | 7/2005 | Simmons et al. | 118/715 |

FOREIGN PATENT DOCUMENTS

| | | |
|---|---|---|
| JP | 2001-314810 | 11/2001 |
| WO | WO 99/19081 | 4/1999 |

OTHER PUBLICATIONS

Eric Leichter et al., "Effect of Helium in Helium Headspace Carbon Dioxide Cylinders on Packed-Column Supercritical Fluid Chromatography", *Anal. Chem.*, vol. 68, pp. 894-898 (1996).

Diana W. Burfield et al., "Vapor-Liquid Equilibria and Dielectric Constants for the Helium-Carbon Dioxide System", *AIChE Journal*, vol. 16(1), pp. 97-100 (1970).

* cited by examiner

DIRECT PRESSURE APPARATUS AND METHOD FOR DISPENSING COATINGS

CROSS-REFERENCE TO RELATED APPLICATION

This application is a continuation of prior application Ser. No. 10/361,727 filed Feb. 11, 2003 now U.S. Pat. No. 6,832,699, which in turn claims the benefit of Provisional Application No. 60/358,351 filed Feb. 22, 2002 under 35 U.S.C. §119(e). The entire contents of these applications are expressly incorporated herein by reference thereto.

FIELD OF THE INVENTION

The invention is related to an apparatus and method for dispensing coatings. In particular, the invention is related to a delivery system that includes at least one pressure vessel within which is stored a deliverable substance having a coating component interspersed with a fluid component.

BACKGROUND OF THE INVENTION

The use of volatile organic compounds as carriers for the delivery of coatings is well-known. However, increasingly there is a need for environmentally friendly carriers which minimize the use of organic carriers such as organic solvents. Supercritical fluids have emerged as such a viable carrier in coating applications, particularly in applications requiring the delivery of a substance in spray form. While supercritical fluids are known to have solvating powers similar to organic solvents, they also present advantages over organic solvents because of their higher diffusivities, lower viscosities, and lower surface tensions.

A supercritical carrier may be considered any compound at a temperature and pressure above certain critical values of temperature and pressure. The critical temperature of a compound is the temperature above which the pure compound in gaseous state cannot be converted to a liquid, while a compound's critical pressure is the vapor pressure of the pure compound in gaseous state at the critical temperature. The critical point of the compound occurs at the temperature and pressure at which the gas and liquid phases are no longer separately defined, but instead a fluid exists in a state that is considered neither liquid nor gas. In the supercritical state, a fluid confers the carrier properties expected from a liquid while at the same time providing transport characteristics expected from gases.

Various compounds are known to exist as supercritical fluids, including ethylene, carbon dioxide, ethane, nitrous oxide, propane, and even methanol and water. The low cost and ready availability of supercritical carbon dioxide have made it a popular choice for a variety of applications. Also, with its critical temperature of 31.1° C., critical pressure of about 73 atm, and critical density of about 470 kg/m$^3$, supercritical carbon dioxide has properties amenable to applications using standard pressure vessel technology.

Various applications have been explored for supercritical carriers, including use in the delivery of protective coatings to various commercial building substrates such as marble, stone, cast stone, architectural terra cotta, concrete, and concrete block. The degradation of such materials due to pollution, acid rain, and other destructive forces can be substantially decreased if a relatively thin protective coating is applied.

Several supercritical fluid technologies have been disclosed by investigators. For example, U.S. Pat. No. 4,923,720 to Lee et al. is directed to the use of supercritical fluids as diluents in the liquid spray application of coatings. A process and apparatus for coating substrates is provided in which a supercritical fluid, such as supercritical carbon dioxide fluid, is used as a viscosity reduction diluent for coating formulations.

However, prior art methods and devices for applying coatings using supercritical fluids suffer from complexity and concomitant bulky equipment, rendering the technology inconvenient to use and inaccessible to many potential customers. Commercial and laboratory equipment for applying coatings using supercritical fluids generally fall into two classes, batch and continuous. Typically, the main storage element of prior art batch systems is a floating piston accumulator. The coating material and supercritical fluid are held captive on one side of the piston, while the pressurization fluid is stored on the other. In such systems, the coating material and $CO_2$ are added at a pressure typically above 1000 psi so that the $CO_2$ remains in a liquid state. Such an arrangement requires high-pressure pumps. After the desired amounts of coating material and $CO_2$ have been added, the two components must be mixed. Mixing usually is effected by circulating material in and out of the piston accumulator. The pressurizing fluid, disposed on the other side of the piston accumulator, is used to effect transport of the deliverable substance through a hose to a spray nozzle. Such batch systems are heavy due to the weight of the piston accumulator, high-pressure pumps, and associated controls. The weight of commercial units ranges between about 3000 lbs and about 1500 lbs. for equipment capable of delivering 6 kgs per batch, not including the $CO_2$ supply bottle.

Continuous systems typically require two or three high-pressure pumps, along with complex flow meters and controls for accurately metering and mixing the coating material and supercritical fluid components. Multiple control loops and a programmable logic controller may be required. Such systems are less common, due to the required level of sophistication of controls. Further, although the commercial, continuous systems are capable of supplying about 100 grams to about 300 grams per minute of deliverable product, they are heavy, typically weighing between about 180 lbs. and 1000 lbs.

The above-described batch and continuous systems are heavy, bulky, require multiple high-pressure pumps, and require heavy $CO_2$ cylinders with high stored energies. These systems also require significant equipment maintenance, as well as an additional energy source to power pumps and controls.

Thus, there exists a need for an improved apparatus and an improved method for dispensing coatings using supercritical fluids. There also exists a need for an apparatus with simplicity in design, compactness, and portability so that the device may be manually transported. Moreover, there exists a need for methods and devices that can deliver coatings with controllable composition and thickness.

SUMMARY OF THE INVENTION

The invention is related to a coating delivery system including a first pressure vessel operable in sealed and unsealed conditions, a deliverable substance having a coating component interspersed with at least one of liquefied carbon dioxide and supercritical carbon dioxide, and a pressurizing fluid. The deliverable substance is disposed in the first pressure vessel. The pressurizing fluid is provided (1) at a pressure greater than the vapor pressure of carbon dioxide if the deliverable substance includes liquefied carbon dioxide, or (2) at a pressure greater than the critical pressure of carbon dioxide if the deliverable substance includes supercritical carbon dioxide. In addition, the pressurizing fluid directly exerts a pressure on the deliverable substance to effect transport thereof when the first pressure vessel is in the unsealed condition.

The first pressure vessel may include a dip tube, a head region, and a deliverable substance region, with the dip tube being disposed in the first pressure vessel and having an inlet proximate the deliverable substance region. The head region of the first pressure vessel may serve as an accumulator for accommodating changes in volume. In some embodiments, a second pressure vessel may be provided, with the pressurizing fluid being disposed in the second pressure vessel in communication with a head region of the first pressure vessel. A regulator may be provided for regulating the transport of pressurizing fluid from the second pressure vessel to the first pressure vessel, and a temperature control system may be provided for changing the temperature of the deliverable substance. The temperature control system may include induction coils, resistive heating coils, or fluid circulation coils.

The coating delivery system optionally may include a circulation loop for recirculating the deliverable substance. The circulation loop may include a pump and a check valve, with the check valve permitting flow of deliverable substance in one direction in the circulation loop. The circulation loop may terminate inside the first pressure vessel remote from the head region. A temperature control system also may be included for changing the temperature of the deliverable substance exiting the pump.

In some embodiments, at least one agitation component such as a magnetic stirrer or at least one mixing ball may be provided for agitating the deliverable substance. The coating delivery system also may include a heated dispensing hose communicating with the first pressure vessel, with the hose having an orifice, spray attachment, or other nozzle attachment for dispensing the deliverable substance.

The coating component may be a polymeric compound. In some embodiments, the coating component may be an enamel, an alkylsilicone resin, or a fluorinated resin. The deliverable substance may include a vapor component, and the pressurizing fluid may be substantially less dense than the vapor component. The pressurizing fluid may be a gas selected from the group consisting of hydrogen, helium, nitrogen, air, oxygen, argon, and methane. In some embodiments, the pressurizing fluid may be a gas selected from the group consisting of helium or hydrogen. The first pressure vessel may have a pressure between about 200 psi and about 4500 psi. A circulation loop may be provided for recirculating deliverable substance, with the circulation loop terminating inside the first pressure vessel remote from a head region thereof.

The invention also is related to a method of applying a coating to a substrate including: providing a deliverable substance in a first pressure vessel, the deliverable substance comprising a coating component interspersed with at least one of liquefied carbon dioxide and supercritical carbon dioxide; providing a first fluid capable of applying pressure to the deliverable substance; allowing the first fluid to directly apply pressure to the deliverable substance (1) at a pressure at least the vapor pressure of carbon dioxide if the deliverable substance comprises liquefied carbon dioxide, or (2) at a pressure at least the critical pressure of carbon dioxide if the deliverable substance comprises supercritical carbon dioxide; delivering the deliverable substance to the substrate.

In some embodiments, the first fluid may be provided in a second pressure vessel that communicates with the first pressure vessel. The method may additionally include heating the deliverable substance prior to spray discharge, pumping the deliverable substance, agitating the deliverable substance, and/or recirculating a portion of the deliverable substance. When the deliverable substance is delivered to the substrate, fluid in a head space of the pressure vessel may remain substantially undisturbed. In addition, the method may include heating the deliverable substance in the first pressure vessel to cause a change in composition of the deliverable substance.

BRIEF DESCRIPTION OF THE DRAWINGS

Preferred features of the present invention are disclosed in the accompanying drawings, wherein similar reference characters denote similar elements throughout the several views, and wherein.

DETAILED DESCRIPTION OF THE PREFERRED EMBODIMENTS

Figure 1:
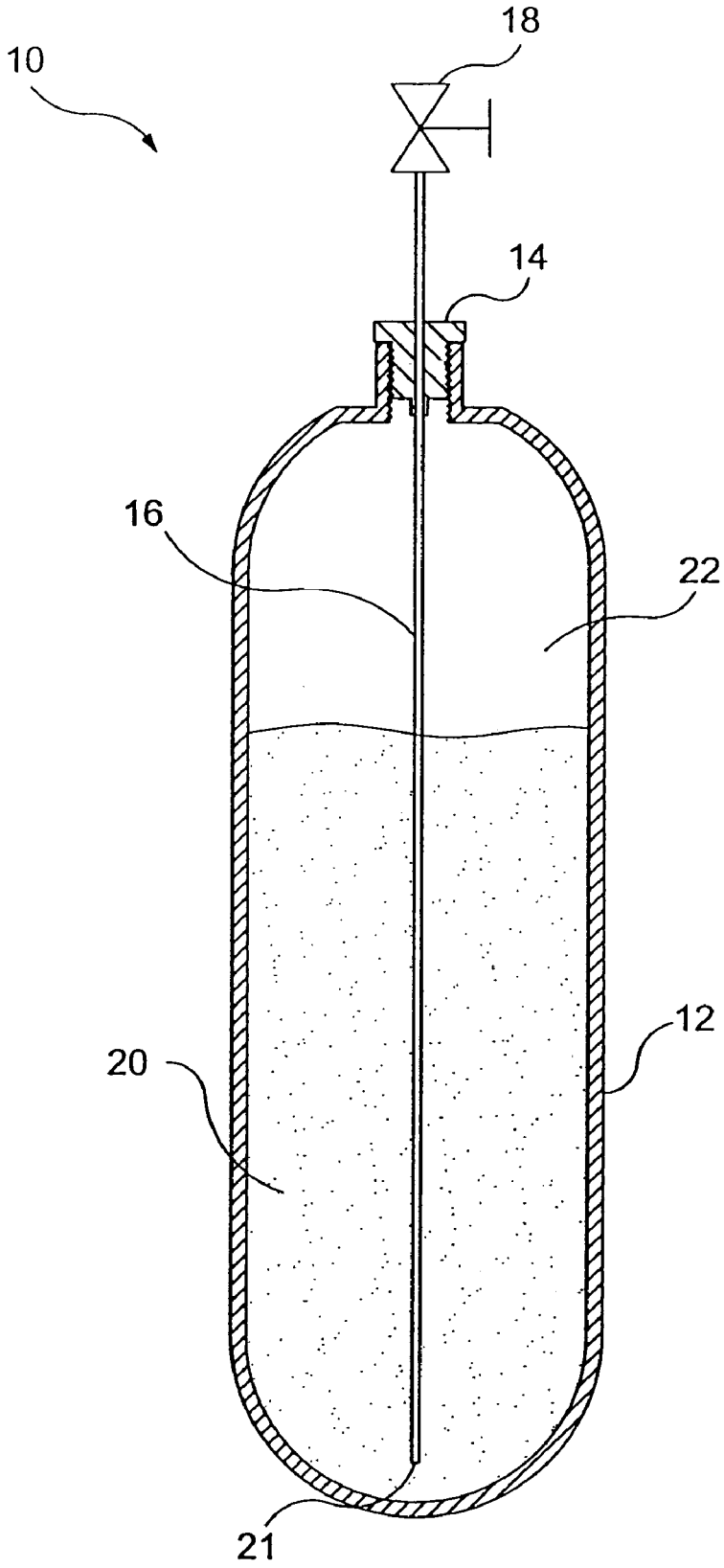
FIG. 1 shows a partial cross-sectional view of a first embodiment of a delivery system according to the present invention with a single pressure vessel.

Referring to FIG. 1, there is shown an exemplary delivery system according to a first embodiment of the present invention. Delivery system 10 includes a pressure vessel 12 with a cylinder fitting 14, a dip tube 16, and a cylinder valve 18. Dip tube 16 has an inlet through which a deliverable substance 20 flows. Preferably, cylinder valve 18 controls the flow of deliverable substance 20, and is connected to a regulator and additional dispensing components (not shown) such as a flexible hose with a suitably sized orifice to permit spraying of deliverable substance 20. Pressure vessel 12 stores a quantity of a deliverable substance 20, which preferably includes a desired coating component interspersed with a fluid component. The coating component preferably is chosen to suit a desired application, and in the preferred embodiment is a paint or resin suitable for application to commercial building substrates. Among the coating components contemplated are acrylics, alkylsilicone resins, and fluorinated resins, however the present invention also may apply to other organics, inorganics, hydrocarbons, and silicones. Both monomers and polymers may be used. The fluid component preferably is chosen from compounds suitable for use in supercritical condition, including $CO_2$, $C_2H_4$, $N_2O$, $NH_3$, n-$C_5$, n-$C_4$, $CCl_2F_2$, and most preferably is $CO_2$. Head space 22 of pressure vessel 12 preferably is filled with a pressurizing gas such as helium or hydrogen. In the preferred embodiment, the pressurizing gas has a density less than the density of the vapor phase of deliverable substance 20. High pressure rated rigid cylinders are preferably used, permitting safe storage of fluids such as liquid carbon dioxide at ambient temperatures. Such cylinders should preferably be rated for use over a pressure range of about 200 psi to about 4500 psi. To prevent cylinder rupture due to over-pressurization, a frangible disk, relief valve, or other safety mechanism may be employed.

The prior art suggests that a substantial quantity of carbon dioxide would be expected to be found in head space 22. From such indication, it would be expected that the composition of deliverable substance 20 would vary as deliverable substance 20 is emptied from pressure vessel 12, due to the transport of some carbon dioxide from deliverable substance 20 to head space 22. Some embodiments of the present invention advantageously permit a generally constant composition of deliverable substance 20 to be delivered, for example by spray, while other embodiments advantageously permit controlled variation in composition to be achieved.

In one exemplary embodiment of the present invention, changes in the composition of deliverable substance 20 may be obtained by selectively heating or cooling the contents of cylinder 12. Preferably, thermoelectric heaters or coolers are employed, such as sock-type devices which may be disposed around cylinder 12. For example, a 4.5% by weight change in composition was experimentally determined using an exemplar formulated composition and $CO_2$ between 20° C. and 40° C. The formulated composition included a fluorinated resin, as described below. The use of thermal devices, of course, is more effective with metallic cylinders (i.e., aluminum) than non-metallic cylinders (ie., carbon fiber) which do not conduct heat as well. Alternatively, cylinder 20 may be surrounded with another liquid, such as in the form of a water bath, in order to control temperature.

Figure 2:
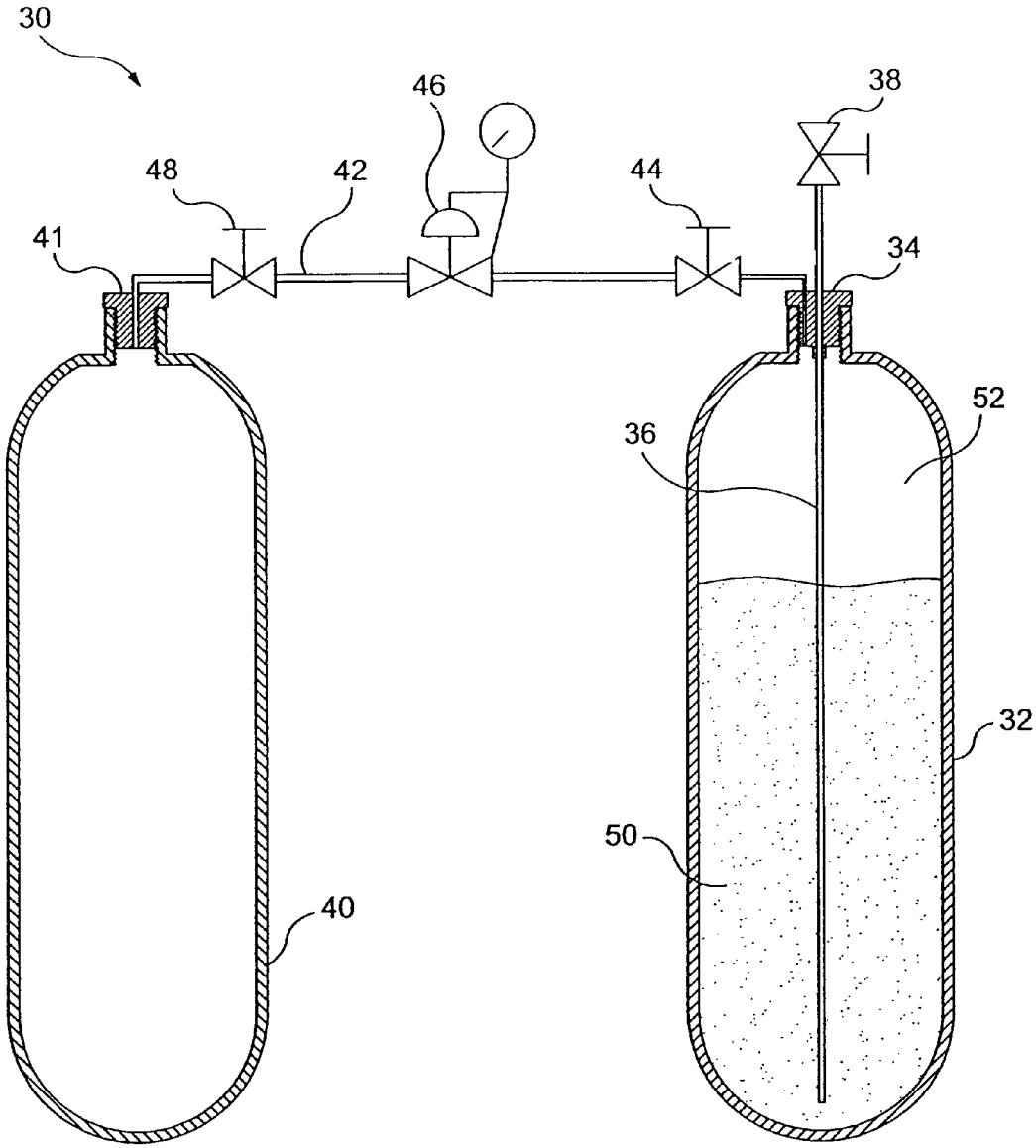
FIG. 2 shows a partial cross-sectional view of a second embodiment of a delivery system according to the present invention with two pressure vessels.

Turning to FIG. 2, a second exemplary embodiment of the present invention is shown. Similar to the embodiment of FIG. 1, delivery system 30 includes a pressure vessel 32 with a cylinder fitting 34, a dip tube 36, and a mixture valve 38. In addition, a second pressure vessel 40 with a cylinder fitting 41 is provided. Cylinders 32 and 40 communicate through a suitable line such as a hose 42. In particular, a head space valve 44, regulator 46, and pressurizing gas valve 48 are connected between cylinders 32 and 40. Pressure vessel 32 stores a quantity of a deliverable substance 50, as described above, while constant pressure is maintained in head space 52 by regulator 46. Head space 52 thus acts as an accumulator, compensating for volume changes occurring, for example, due to changes in temperature. Advantageously, use of delivery system 30 with two pressure vessels 32 and 40 permits a constant spray pressure to be achieved for substance 50 exiting mixture valve 38. In one non-limiting exemplary arrangement, cylinder 40 may be filled to an initial pressure of 3000 psi with helium gas, while head space 52 of cylinder 32 may be pressurized with the helium gas at a generally constant pressure of 1500 psi using regulator 46. Further, such a two-cylinder system facilitates pressure regulation, because it is generally easier to regulate the pressure of a gas than a liquid.

Experimentation was performed to determine whether a substantial variation in composition of deliverable substance 50 occurs during delivery using delivery system 30. Unexpectedly, no substantial variation in coating composition was found when delivery occurred without mixing of the head space during delivery. Several coating components were tested in a manner as described below. Sherwin Williams Industrial Enamel HS #B54TZ404, listed below as Exemplar A, was tested as an exemplar paint for application with the present invention. In addition, a high performance all-purpose solvent reducible water repellent for mineral substrates, product designation BS 290 supplied by Wacker Silicones Corporation (Adrian, Mich.), listed below as Exemplar B, was also tested as an exemplar coating for application with the present invention. BS 290 is an alkyl-silicone resin with alkoxy groups. Furthermore, a formulated composition whose main ingredient is a fluorinated resin with molecular weight less than 15,000, listed below as Exemplar C, was also tested as another exemplar resin for application with the present invention. The carbon dioxide was commercial grade $CO_2$ supplied in 50 lb. bottles.

Testing was conducted by filling a 4.7 liter internal volume carbon fiber pressure bottle with coating component and carbon dioxide by weight. For example, 3000 g of Exemplar C composition and 1500 g of $CO_2$ were used in a test run having a Exemplar C composition:$CO_2$ ratio of 2:1. A pressure vessel with dip tube was used, as arranged with pressure vessel 32 in FIG. 2. After the coating component and $CO_2$ were added, the pressure vessel was shaken gently until the coating component and $CO_2$ were thoroughly mixed. Pressurizing gas was supplied from a large nitrogen or helium bottle at 2500 psig, arranged as pressure vessel 40 shown in FIG. 2. A regulator was used with the nitrogen/helium bottle for supplying pressurizing gas to the coating component bottle. The pressurizing gas was supplied at about 1250 psig during testing for Exemplars A, B and about 500 psig during testing for Exemplar C. The regulated pressures were chosen because they represent nominal pressures for supercritical $CO_2$ spraying applications. As in FIG. 2, a valve 38 communicated with dip tube 36, and a flexible hose was connected from the valve to a mass flow corrolis meter for measuring flow rate and density. Pressure vessel 32 was submersed in a water bath with the water temperature regulated by a temperature control system. The content of pressure vessel 32 was slowly metered out with a pressure valve and capillary to simulate typical spray rates (approximately 4.5 kg/h). Temperature, flow, pressure, and density were measured every 5 seconds for the duration of the run and recorded using Allen Bradley data acquisition software.

Changes in composition of deliverable substance 50 were determined from variations in the density measurements. Because there is a large difference in the density of the coating component and the density of liquid $CO_2$ (approximately 0.8 g/cc), changes in density could accurately be related to changes in composition. Table I below lists exemplar test data:

TABLE I

| Test No. | Temp. (° C.) | Pressurizing Gas | Ratio of Coating Component to $CO_2$ | Coating Exemplar Designation | Average Density | Std. Dev. of Density |
|---|---|---|---|---|---|---|
| 1 | 20 | Helium | 5.3:1 | A | 1.0901 | 0.0004 |
| 2 | 20 | Nitrogen | 5.2:1 | A | 1.1280 | 0.0020 |
| 3 | 20 | Nitrogen | 2:1 | B | 1.0428 | 0.0007 |
| 4 | 30 | Nitrogen | 2:1 | C | 1.4533 | 0.0060 |
| 5 | 20 | Nitrogen | 2:1 | C | 1.4217 | 0.0016 |
| 6 | 20 | Nitrogen | 2:1 | C | 1.4416 | 0.0025 |
| 7 | 40 | Nitrogen | 1.6:1 | C | 1.3656 | 0.0065 |
| 8 | 20 | Helium | 2:1 | C | 1.4594 | 0.0006 |
| 9 | 40 | Helium | 2:1 | C | 1.4950 | 0.0035 |
| 10 | 20 | Helium | 5.2:1 | A | 0.9987 | 0.0168 |
| 11 | 30 | Helium | 2:1 | C | 1.4794 | 0.0413 |
| 12 | 20 | Nitrogen | 2:1 | C | 1.4899 | 0.0489 |

It should be noted that fluid in head space 52 in pressure vessel 32 was mixed in Test Nos. 10, 11 and 12, as will be described below, while fluid in head space 52 in the remaining listed tests was not mixed. The large increase in standard deviation for Test Nos. 10, 11 and 12, evident in Table I, indicates a substantial change in the density of the deliverable substance.

The measured density during emptying may be used as an indication of change, or lack thereof, in the composition of the discharged mixture. For example, the density of each pure coating component was measured at 20° C. and at the spray pressure in order to determine accurate density at elevated pressure. The density of the discharged mixture, ρ(mixture), was measured at ambient temperature for comparison. Using Eq. 1, the density of the discharged mixture is related to the mass percents of the coating component and $CO_2$ in the mixture, the density of the coating component, ρ(coating), and the density of the $CO_2$, $\rho(CO_2)$:

$$\rho(\text{mixture})=[(\text{coating component mass }\%)\times\rho(\text{coating})]+[(CO_2\text{ mass }\%)\times\rho(CO_2)] \quad \text{Eq. 1}$$

Thus, Eq. 1 may be used to determine estimates of the relative changes in composition, particularly if the density of the coating component is significantly different from the density of $CO_2$. However, because Eq. 1 does not account for the effects of dissolved pressurizing gas or the effective densities of the components in the mixture, only relative changes may be estimated. For example, it is estimated that for Test No. 5, as the cylinder was emptied, less than one percent by weight change in composition occurred.

Figure 3:
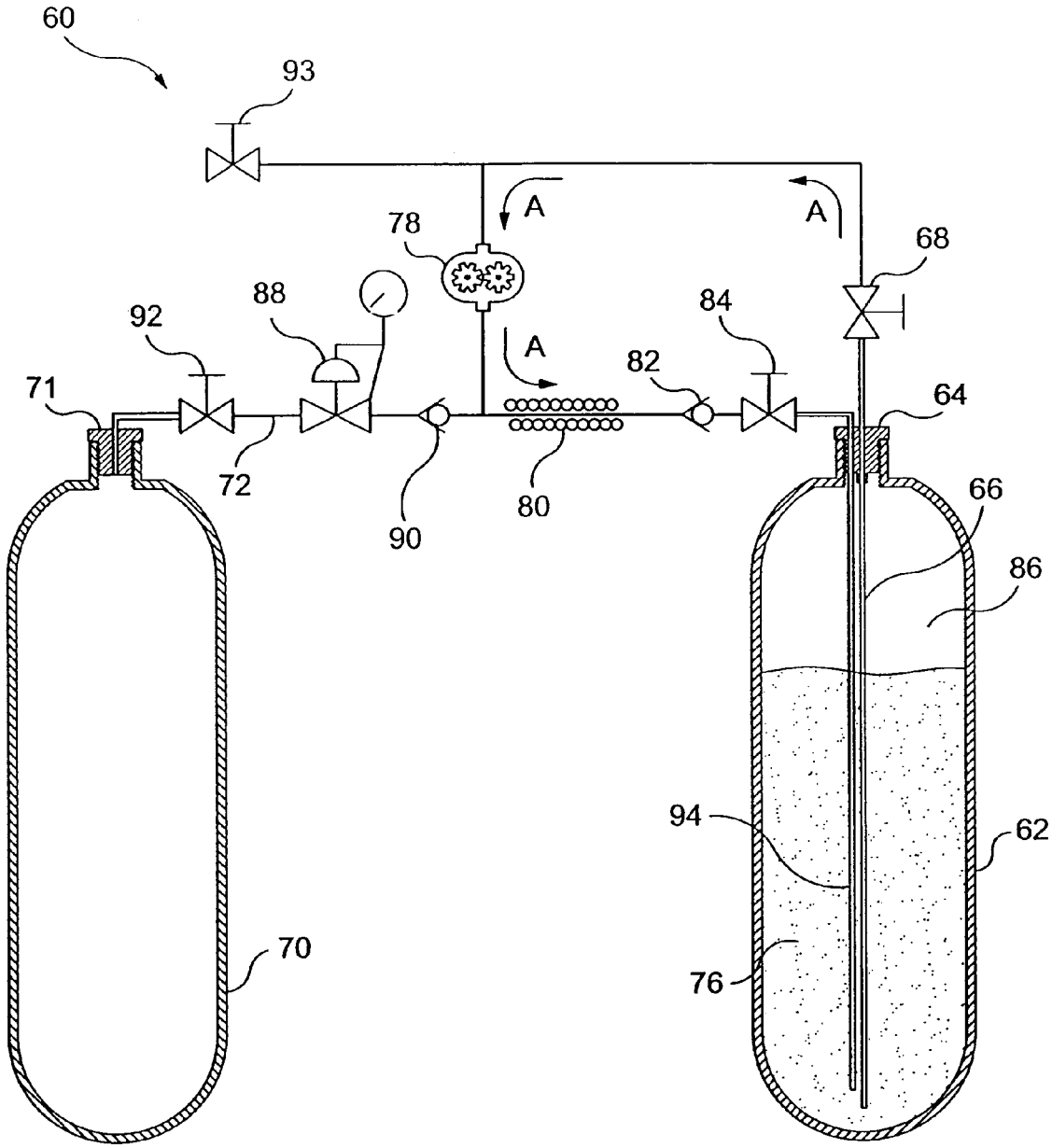
FIG. 3 shows a partial cross-sectional view of another embodiment of a delivery system according to the present invention with two pressure vessels and a circulation loop.

Referring next to FIG. 3, a third exemplary embodiment of the present invention is shown. Delivery system 60 includes a pressure vessel 62 with a cylinder fitting 64, a dip tube 66, and a vessel isolation valve 68. In addition, a second pressurizing gas vessel 70 with a cylinder fitting 71 is provided. Vessels 62 and 70 communicate through a suitable line such as a hose 72. A circulation loop A is provided, and deliverable substance 76 is circulated by a pump 78. Heater 80, such as temperature-controlled coils, permits the temperature of deliverable substance 76 exiting from pump 78 to be changed, and loop A is completed with a check valve 82 and a vessel isolation valve 84. Check valve 82 prevents backflow in a direction opposite from that indicated by arrows in FIG. 3, while vessel isolation valves 68 and 84 permit pressure vessel 62 to be removed and exchanged with another pressure vessel. When deliverable substance 76 is returned by loop A to pressure vessel 62, it is released remote from head space 86 via a dip tube 94, so as not to directly mix head space 86 during discharge of deliverable substance 76.

In order to permit a constant spray pressure to be achieved, a regulator 88 is provided between pressure vessels 62 and 70. Check valve 90 is provided to ensure that circulating fluid in loop A cannot flow to regulator 88 or vessel 70. In addition, a vessel isolation valve 92 is provided so that pressure vessel 70 may be changed. Deliverable substance 76 is expelled from valve 93 to an orifice, spray hose, or other discharge component.

Advantageously, the embodiment of FIG. 3 is particularly suitable for delivering deliverable substance 76 at selectable compositions. Thus, if a thin or thick mixture is required for a given application, the density of the mixture may be varied by changing the temperature of deliverable substance 76 and thus changing the ratio of carbon dioxide to coating component. Increasing the temperature of deliverable substance 76 results in a decrease in carbon dioxide content in deliverable substance 76, whereas decreasing the temperature of deliverable substance 76 results in an increase in carbon dioxide content in deliverable substance 76.

Figure 4:
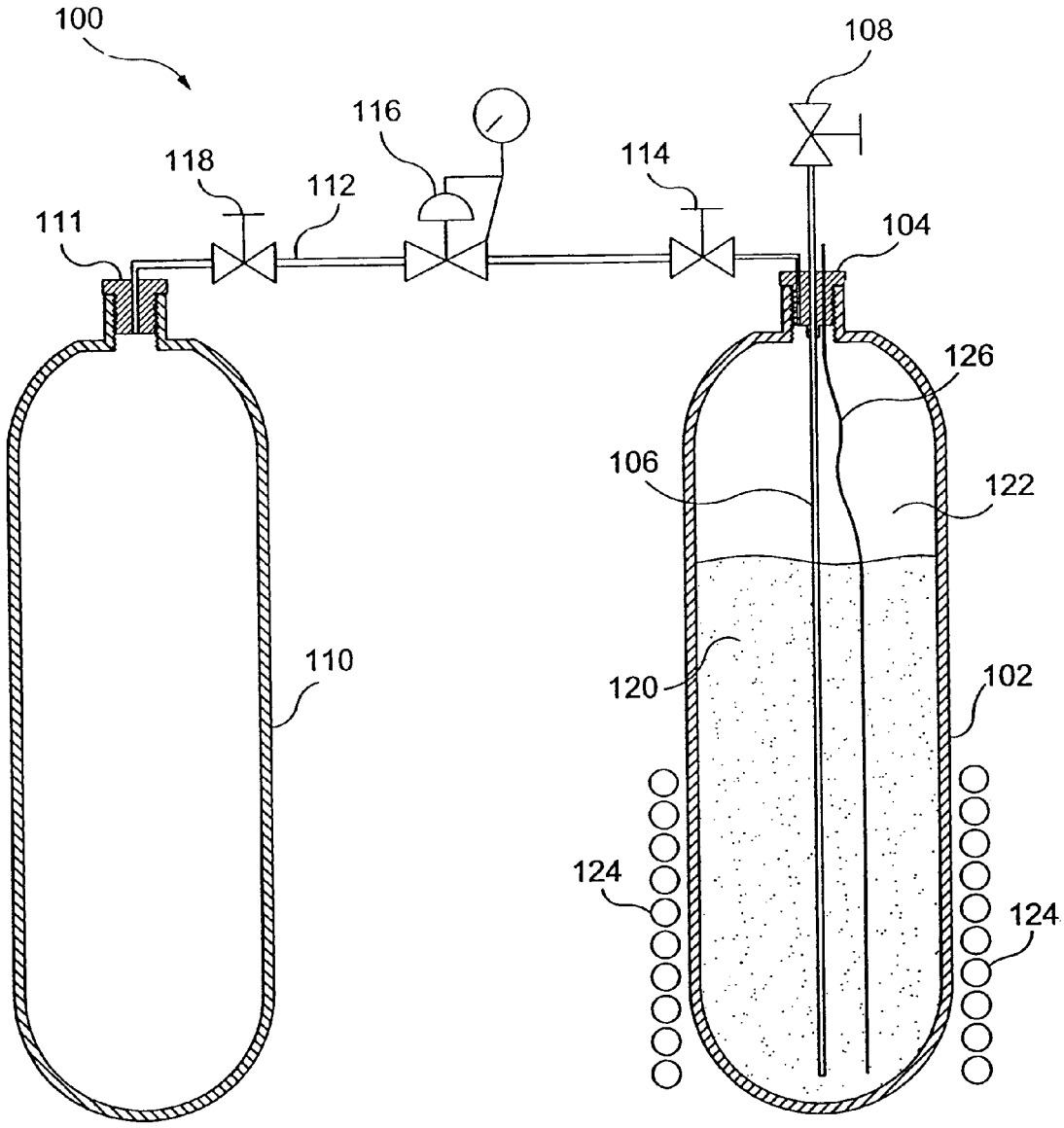
FIG. 4 shows a partial cross-sectional view of yet another embodiment of a delivery system according to the present invention with two pressure vessels and selectable temperature control.

Another exemplary embodiment of the present invention is shown in FIG. 4. Delivery system 100 includes a pressure vessel 102 with a cylinder fitting 104, a dip tube 106, and a mixture valve 108. In addition, a second pressurizing gas vessel 110 with a cylinder fitting 111 is provided. Vessels 102 and 110 communicate through a suitable line such as a hose 112. In particular, a head space valve 114, regulator 116, and pressurizing cylinder valve 118 are connected between cylinders 102 and 110. Pressure vessel 102 stores a quantity of a deliverable substance 120, as described above, while constant pressure is maintained in head space 122 by regulator 116. Coils 124, preferably induction coils, are provided proximate the outer wall of pressure vessel 102, and may be selectively energized to change the temperature of deliverable substance 120 and thus the ratio of carbon dioxide to coating component for its composition. In alternate embodiments of delivery system 100, coils 124 may be resistive heating coils or heating/cooling fluid circulation coils. A thermocouple 126 is preferably run into vessel 102 to measure the temperature of deliverable substance 120.

The delivery system of the present invention may be supplied "turnkey," so that a user need only unpack the system and attach a suitable spray hose with an orifice to the cylinder valve. The cylinder initially may be provided with suitable pressurizing gas and deliverable substance. The head space of the cylinder may serve as an accumulator, compensating for volume changes occurring, for example, due to changes in temperature.

In preferred embodiments of the present invention, a heated hose is connected to the delivery system. The heated hose, for example, permits a desired coating component intermixed with liquid/supercritical carbon dioxide, to be delivered with desired spray characteristics such as droplet size. In addition, heating may permit the deliverable substance to be discharged without solidification proximate the nozzle, and thus plugging of the delivery system can be averted. In one preferred embodiment, a substance enters the final delivery hose at a temperature of 20° C. and is heated to a temperature of 50° C. at the exit of the hose proximate the nozzle.

Preferably, pressure vessels 12, 32, 40, 62, 70, 102, 110 are provided as cylinders or other suitably rigid tanks. Although carbon fiber cylinders are preferred, other cylinders such as fiberglass, aramid, aluminum or steel cylinders may be used.

In addition, pressure vessels disclosed in the present invention may be provided with means for producing agitation, such as magnetic stirrers, one or more mixing balls, or other agitation arrangements. Such agitation is advantageous because when pressurizing gas is applied to the head space, it causes some of the gaseous $CO_2$ to be liquefied due to the increase in pressure. The $CO_2$ is less dense than the coating component, and thus stratifies above the coating component/$CO_2$ mixture creating a non-homogenous mixture. Further, homogenous systems also may develop density gradients, over time, due to the vastly different densities of the mixture components (coating component and $CO_2$). Preferably, mixing is undertaken after pressurization. However, care should be taken to minimize mixing of the head space of the pressure vessel, so that it remains undisturbed during emptying and the density gradient remains largely unchanged. As discussed above, testing conducted under the conditions listed in Table I for Test Nos. 10, 11 and 12 included mixing in head space 52 in pressure vessel 32.

Figure 5:
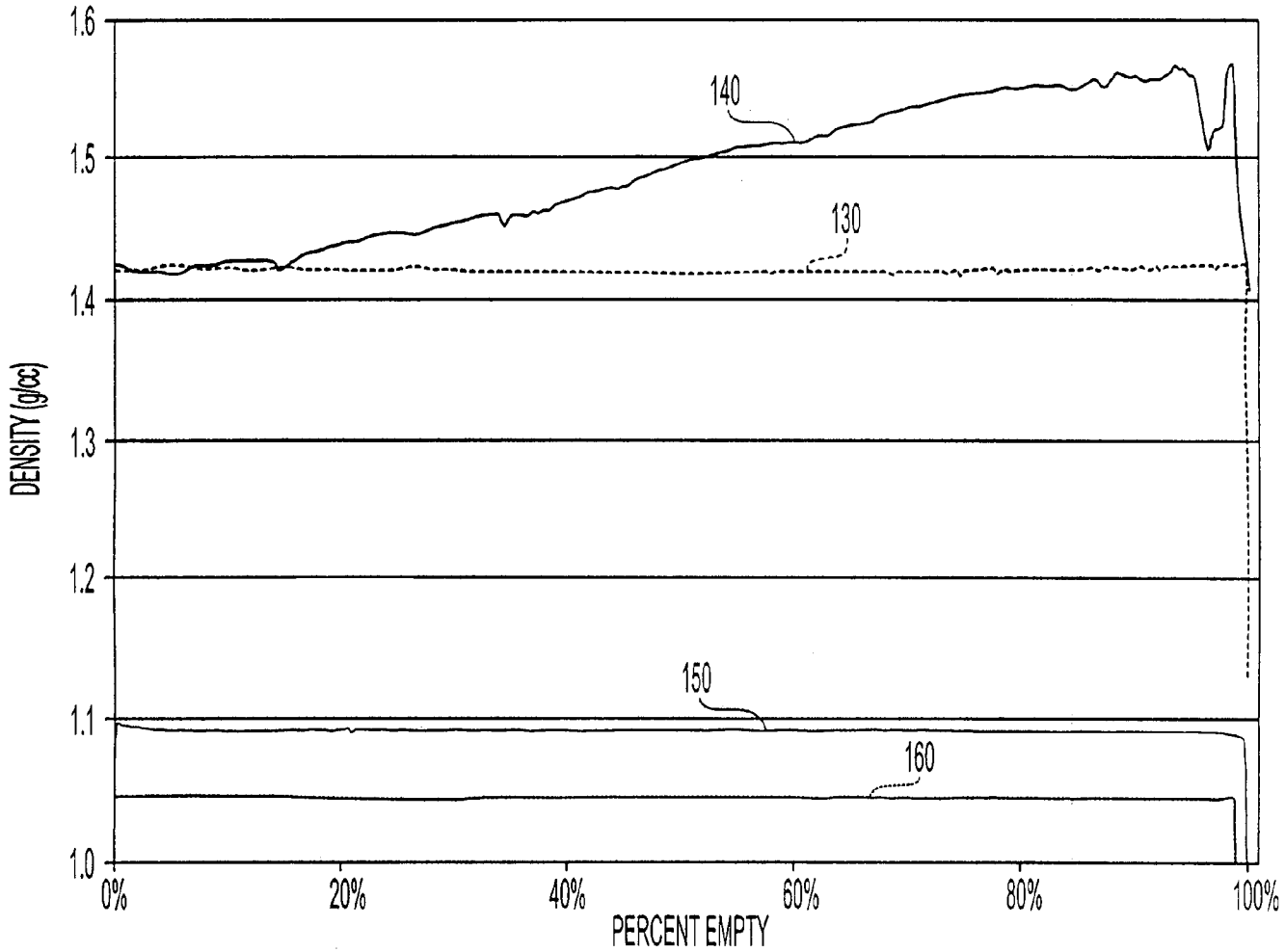
FIG. 5 shows a graph of data from Test No. 1 (no mixing), Test No. 3 (no mixing), Test No. 5 (no mixing) and Test No. 12 (mixing), with the density of the deliverable substance shown as a function of the percent of the pressure vessel that has been emptied.

Fluid in head space 52 was disturbed by pumping a stream of recirculated mixture (deliverable substance 50) into the top of pressure vessel 32. The recirculation occurred at a flow rate of approximately 700 cc/min. Because the recycled flow significantly disturbed the density gradient in the head space, an increase in $CO_2$ transfer to the head space occurred. This resulted in a substantial change in mixture density while the pressure vessel was emptied from an initially full condition. A comparison of the results of Test No. 5 (no mixing), identified as data 130, and Test No. 12 (mixing), identified as data 140, described above in Table I, is depicted graphically in FIG. 5. In addition, the results for Test No. 1 (no mixing), identified as data 150, and Test No. 3 (no mixing), identified as data 160, are shown for further comparison. The density of the deliverable substance (in g/cc) is shown as a function of the percent of the pressure vessel that has been emptied.

In one exemplary, preferred embodiment of the present invention, the delivery system is provided in compact, lightweight form to permit transport in a midsize automobile and single-person handling. Such an embodiment, for example, may have two pressure vessels, an overall size of 26"×12"×48", and an overall weight of about 70 lbs. Cylinders are preferably pre-filled, requiring minimal preparation by users, and the delivery system may be used in a batch process. In addition, due to the size and weight, and concomitantly the nature of the materials that are used, the delivery systems may be shipped by common carrier.

Advantageously, some of the embodiments of the present invention may be operated without the used of external energy sources, which for example, are typically required with prior art delivery systems which employ one or more pumps and control systems. Pumps, in particular, require significant energy. Moreover, some of the embodiments of the present invention preferably only require an energy source for the heated-discharge hose. Such an energy source may be provided in a small battery pack, which may be directly attached to the delivery system or connected to the heated discharge hose yet carried, for example, on the waist belt of a workman using the system.

While various descriptions of the present invention are described above, it should be understood that the various features can be used singly or in any combination thereof. Therefore, this invention is not to be limited to only the specifically preferred embodiments depicted herein.

Further, it should be understood that variations and modifications within the spirit and scope of the invention may occur to those skilled in the art to which the invention pertains. For example, the delivery systems of the present invention may be used in supercritical fluid extraction and supercritical fluid chromatography. Furthermore, the delivery systems of the present invention may be used in industrial painting applications, such as automotive painting. In addition, each of the delivery systems may be configured to be portable, for example, as a back-pack unit. Also, other embodiments may include more than two pressure vessels. For example, a coating delivery system may include two pressure vessels for storing and selectively delivering different deliverable substances, while a third pressure vessel may be included for storing pressure conveying fluid. Alternatively, a coating delivery system may include several pressure vessels of a standardized size which contain the same deliverable substance, thereby in the aggregate providing greater volume of available deliverable substance when a coating is being applied. Accordingly, all expedient modifications readily attainable by one versed in the art from the disclosure set forth herein that are within the scope and spirit of the present invention are to be included as further embodiments of the present invention. The scope of the present invention is accordingly defined as set forth in the appended claims.

What is claimed is:

1. A method of applying a coating to a substrate comprising:

providing a deliverable substance in a first pressure vessel, the deliverable substance comprising a coating component interspersed with a fluid component, wherein the fluid component is selected from the group consisting of liquefied carbon dioxide, supercritical carbon dioxide, and mixtures thereof;

providing a pressurizing fluid capable of applying pressure to the deliverable substance, wherein the pressurizing fluid is different from the fluid component; allowing the pressurizing fluid to directly apply pressure to the deliverable substance (1) at a pressure of at least vapor pressure of the carbon dioxide if the fluid component comprises liquefied carbon dioxide, or (2) at a pressure of at least critical pressure of the carbon dioxide if the fluid component comprises supercritical carbon dioxide, wherein the pressurizing fluid contacts the deliverable substance in a head space of the first pressure vessel;

delivering the deliverable substance to the substrate without substantial variation in composition of the deliverable substance as the first pressure vessel is emptied during delivery thereof.

2. The method of claim 1, wherein the first fluid is provided in a second pressure vessel that communicates with the first pressure vessel.

3. The method of claim 1, further comprising heating the deliverable substance prior to spray discharge.

4. The method of claim 1, further comprising pumping the deliverable substance.

5. The method claim 1, further comprising agitating the deliverable substance.

6. The method of claim 1, further comprising recirculating a portion of the deliverable substance.

7. The method of claim 1, wherein when the deliverable substance is delivered to the substrate, fluid in a the head space of the first pressure vessel remains substantially undisturbed.

8. The method of claim 1, further comprising heating the deliverable substance in the first pressure vessel to cause a change in composition of the deliverable substance.

9. A method of coating a substrate comprising:

providing a deliverable substance in a first pressure vessel, the deliverable substance comprising a coating component interspersed with a fluid component, wherein the fluid component is selected from the group consisting of liquefied carbon dioxide, supercritical carbon dioxide, and mixtures thereof;

providing a pressurizing gas that is different from the fluid component;

allowing the pressurizing gas to directly apply pressure to the deliverable substance (1) at a pressure of at least vapor pressure of the carbon dioxide if the fluid component comprises liquefied carbon dioxide or (2) at a pressure of at least critical pressure of the carbon dioxide if the fluid component comprises supercritical carbon dioxide, wherein the pressurizing gas contacts the deliverable substance in a head space of the first pressure vessel;

delivering the deliverable substance to a discharge site in communication with the first pressure vessel;

releasing the coating component from the first pressure vessel though the discharge site while directly applying pressure on the deliverable substance with the pressurizing gas, without substantial variation in density of the deliverable substance as the first pressure vessel is emptied during release of the coating component;

directing the coating component released though the discharge site to the substrate.

10. The method of claim 9, wherein the pressurizing gas is supplied from a second pressure vessel that communicates with the first pressure vessel while the coating component is released therefrom.

11. The method of claim 9, further comprising: heating the deliverable substance and then spray discharging the coating component through the discharge site.

12. The method of claim 9, further comprising pumping the deliverable substance.

13. The method claim 9, further comprising agitating the deliverable substance.

14. The method of claim 9, further comprising recirculating a portion of the deliverable substance.

15. The method of claim 9, wherein when the coating component is released through the discharge site, fluid in the head space of the first pressure vessel remains substantially undisturbed.

16. The method of claim 9, further comprising heating the deliverable substance in the first pressure vessel to cause a change in composition of the deliverable substance.

17. A method of delivering a coating material comprising:

creating a mixture by mixing the coating material with a supercritical fluid in a pressure vessel;

directly applying pressure on the mixture with a pressurizing fluid different from the supercritical fluid, the pressurizing fluid contacting the deliverable substance in a head space of the pressure vessel;

the pressure applied by the pressurizing fluid being at least critical pressure of the supercritical fluid, with the pressurizing fluid having a first density, the mixture having a second density, and the first density being substantially lower than the second density;

delivering the mixture to a discharge component;

releasing the coating material from the pressure vessel through the discharge component while directly applying pressure on the mixture with the pressurizing fluid.

18. The method of claim 17, wherein the pressurizing fluid is disposed at a regulated pressure in the head space of the pressure vessel.

19. The method of claim 18, wherein the pressure of the pressurizing fluid is substantially constant in the head space.

20. The method of claim 17, wherein the pressurizing fluid is a gas selected from the group consisting of helium, hydrogen, and nitrogen.

21. The method of claim 17, wherein the supercritical fluid is supercritical carbon dioxide.

22. A method of delivering a coating material comprising:

creating a mixture by mixing the coating material with liquefied carbon dioxide in a pressure vessel;

directly applying pressure on the mixture with a pressurizing fluid different from the liquefied carbon dioxide, the pressurizing fluid contacting the mixture in a head space of the pressure vessel, the pressure applied by the pressurizing fluid being at least vapor pressure of the carbon dioxide, with the pressurizing fluid having a first density, the mixture having a second density, and the first density being substantially lower than the second density;

delivering the mixture to a discharge component;

releasing the coating material from the pressure vessel through the discharge component while directly applying pressure on the mixture with the pressurizing fluid.

23. The method of claim 22, wherein the pressurizing fluid is disposed at a regulated pressure in the head space of the pressure vessel.

24. The method of claim 23, wherein the pressure of the pressurizing fluid is substantially constant in the head space.

25. The method of claim 22, wherein the pressurizing fluid is a gas selected from the group consisting of helium, hydrogen, and nitrogen.

26. A method of coating a substrate comprising:

discharging a deliverable substance from a pressure vessel to the substrate by directly applying pressure with a pressurizing fluid against the deliverable substance without variation in composition of the deliverable substance as the pressure vessel is emptied during discharge thereof;

wherein the pressurizing fluid contacts the deliverable substance in a head space of the pressure vessel;

wherein the deliverable substance comprises a coating component interspersed with supercritical carbon dioxide, the pressurizing fluid being different from carbon dioxide and having a substantially lower density than carbon dioxide;

wherein the pressure applied by the pressurizing fluid is at least critical pressure of the carbon dioxide.

27. The method of claim 26, wherein the pressurizing fluid is disposed at a regulated pressure in the head space of the pressure vessel.

28. The method of claim 27, further comprising:

maintaining the pressure of the pressurizing fluid to be substantially constant in the head space.

* * * * *

UNITED STATES PATENT AND TRADEMARK OFFICE

CERTIFICATE OF CORRECTION

PATENT NO. : 7,297,371 B2
APPLICATION NO. : 10/959092
DATED : November 20, 2007
INVENTOR(S) : Simmons et al.

It is certified that error appears in the above-identified patent and that said Letters Patent is hereby corrected as shown below:

In claim 7, Col. 10, line 42, delete "a".

Signed and Sealed this

Eighth Day of April, 2008

JON W. DUDAS
*Director of the United States Patent and Trademark Office*